United States Patent [19]

Enomoto

[11] Patent Number: 4,723,143

[45] Date of Patent: Feb. 2, 1988

[54] IMAGE REPRODUCTION DEVELOPING DEVICE WITH A VIBRATING SUPPLY HOPPER PARTITION ATTACHMENT

[75] Inventor: Masayuki Enomoto, Hachioji, Japan

[73] Assignee: Konishiroku Photo Industry Co., Ltd., Tokyo, Japan

[21] Appl. No.: 22,272

[22] Filed: Mar. 5, 1987

[30] Foreign Application Priority Data

Mar. 11, 1986 [JP] Japan ..... 61-51309

[51] Int. Cl.[4] ..... G03G 15/08

[52] U.S. Cl. ..... 355/3 DD; 355/14 D; 355/3 R; 118/653; 118/657

[58] Field of Search ..... 355/3 DD, 14 D, 15; 366/241, 279, 297, 292; 118/653, 657, 658

[56] References Cited

U.S. PATENT DOCUMENTS

| | | | |
|---|---|---|---|
| 3,838,472 | 10/1974 | Oriel | 355/15 X |
| 4,155,328 | 5/1979 | Navone | 118/657 |
| 4,188,907 | 2/1980 | Lipani | 118/657 |
| 4,226,524 | 10/1980 | Hashimoto | 118/657 X |

FOREIGN PATENT DOCUMENTS

| | | | |
|---|---|---|---|
| 0204070 | 12/1982 | Japan | 118/658 |
| 0000471 | 1/1985 | Japan | 355/3 DD |
| 0069668 | 4/1985 | Japan | 355/3 DD |
| 0172058 | 9/1985 | Japan | 355/3 DD |

*Primary Examiner*—Arthur T. Grimley
*Assistant Examiner*—John G. Smith
*Attorney, Agent, or Firm*—Bierman and Muserlian

[57] ABSTRACT

A developing device for a reproducing machine, in which a partition is arranged between a developer supply hopper and a developer bath which has a developing sleeve and developer agitating blades therein, arranged to face an image retainer. An aperture is formed in the partition and covered with an easily deformable thin elastic plate. The developer agitating blades in the developer bath are arranged in the vicinity of the apertures so that the elastic plate is vibrated when the developer projected by the rotation of the developer agitating blades is impinged to the elastic plate, thereby preventing the bridging of toner in the supply hopper.

8 Claims, 2 Drawing Figures

IMAGE REPRODUCTION DEVELOPING DEVICE WITH A VIBRATING SUPPLY HOPPER PARTITION ATTACHMENT

BACKGROUND OF THE INVENTION

1. Field of the Invention

The present invention relates to a developing device for a reproducing machine or the like and, more particularly, to a developing device which is equipped with a supply hopper for supplying a developer to the inside of a developer bath.

2. Description of the Prior Art

In a developing device for a reproducing machine or the like, generally speaking, it is necessary to supply a developer corresponding to the amount consumed for development.

In the reproducing machine of the prior art, therefore, a supply hopper is disposed above the developing device to supply a developer corresponding to the replenishment amount therefrom to the developing device. If, however, the developer is held still in that supply hopper, it is stabilized to cause bridging phenomena thereby to make the supply of the developer difficult. The bridging phenomena means such phenomena that only the developer near the feed roller is supplied because the developer in the developer supply hopper is packed. Thus a space is formed between the feed roller and the developer located at the upper portion of the developer supply hopper thereby causing the supply of the developer impossible.

In the prior art, therefore, the supply hopper is periodically beaten or vibrated by a beater provided on the side of the supply hopper or a vibrator is additionally provided to the same hopper to apply a mechanical force to the stabilized developer thereby to prevent occurrence of the bridging phenomena.

However, this developing device of the prior art requires the beater and vibrator to raise its production cost and to complicate its construction. Moreover, the device of the prior art produces noises to deteriorate the office circumstances which should be quiet.

SUMMARY OF THE INVENTION

In view of the aforementioned problem of the developing device of the prior art, an object of the present invention is to provide a developing device which can be expected to block occurrence of the bridging phenomena of the developer in the supply hopper and to ensure a quiet run.

In order to achieve this object, according to the present invention, there is proposed a developing device for a reproducing machine or the like, in which a developer supply hopper is incorporated into a developer bath housing arranged to face an image retainer, characterized in that apertures are formed in a partition provided between the developer bath, which has a developing sleeve and developer agitating blades therein, and the inside of said supply hopper; in that said apertures are covered with easily deformable thin elastic plates; and in that said agitating blades in said developer bath are arranged in the vicinity of said apertures.

DESCRIPTION OF THE PREFERRED EMBODIMENT

Figure 1:
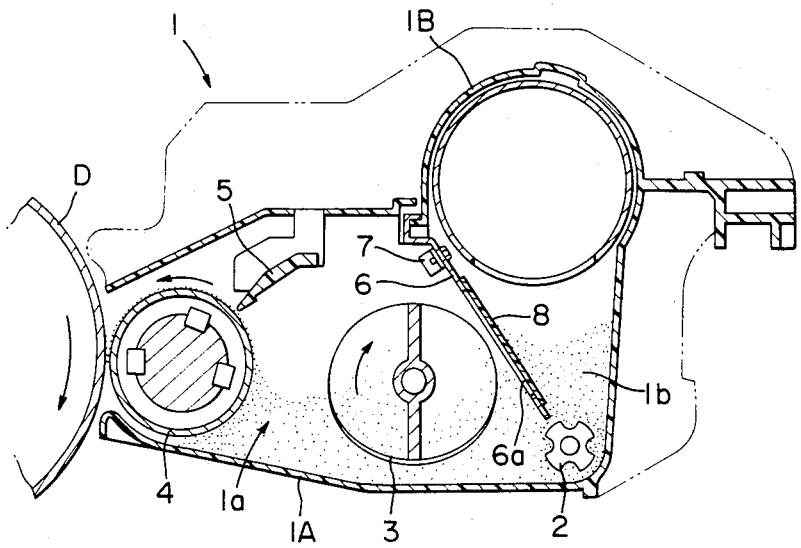
FIG. 1 is a section showing a developing device according to the present invention.

First of all, a developing device of the shown embodiment will be described in its entirety. This developing device 1 is equipped with a developer bath housing 1A which has a supply hopper **1*b* for receiving developer for replenishment poured and which is arranged to face an image retainer D. Above the supply hopper 1*b*, there is arranged a cartridge type supply reservoir 1B which can be inserted normal to the surface of the paper on which FIG. 1 is drawn. A constant quantity of developer for replenishment is poured from that supply reservoir 1B into the supply hopper 1*b*. Below this supply hopper 1*b*, there is positioned a feed roller 2 which is rotated in response to a supply command signal sent from a control unit of a reproducing machine. The developer in the supply hopper 1*b* is supplied to a developer bath owing to the rotation of the feed roller 2**.

On the other hand, the developer in the developer bath 1a is frictionally charged by agitating blades 3 which are rotated in the developer bath. The developer thus charged is magnetically attracted by the circumference of a developing sleeve 4 which is arranged in the vicinity of the image retainer D, and is leveled to an even layer by a doctor blade 5 as the developing sleeve 4 rotates in the direction of arrow, until it is supplied to the image retainer D.

In the case of the shown embodiment, the inside of the developer bath housing 1A is partitioned into the developer supply hopper and the developer bath by a partition 6. This partition 6 is fixed in the developer bath housing 1A by angular members 7 to completely shield the two baths by having its two end portions fitted in sloped grooves formed in the end walls of the developer bath housing 1A.

Moreover, in the surface of the partition 6 are formed a plurality of apertures **6*a* which are arrayed in the longitudinal direction, i.e., normal to the surface of the paper on which FIG. 1 is drawn. These apertures 6*a* are covered with elastic plates 8 which can be easily deformed and which have their peripheral portions adhered to the aforementioned partition 6. Those elastic plates 8** are constructed of such elastic thin plates as can be easily deformed by the pressure of the developer in the developer bath, and can be made of a plate of a Mylar (polyethylene terephtalate sheet or another thin resin or a thin rubber film.

Further, if the transparent elastic plates 8 are used the states of the parts to be mounted on the developing device can be investigated at the assembling thereof and the color of the developer to be used can be confirmed.

Figure 2:
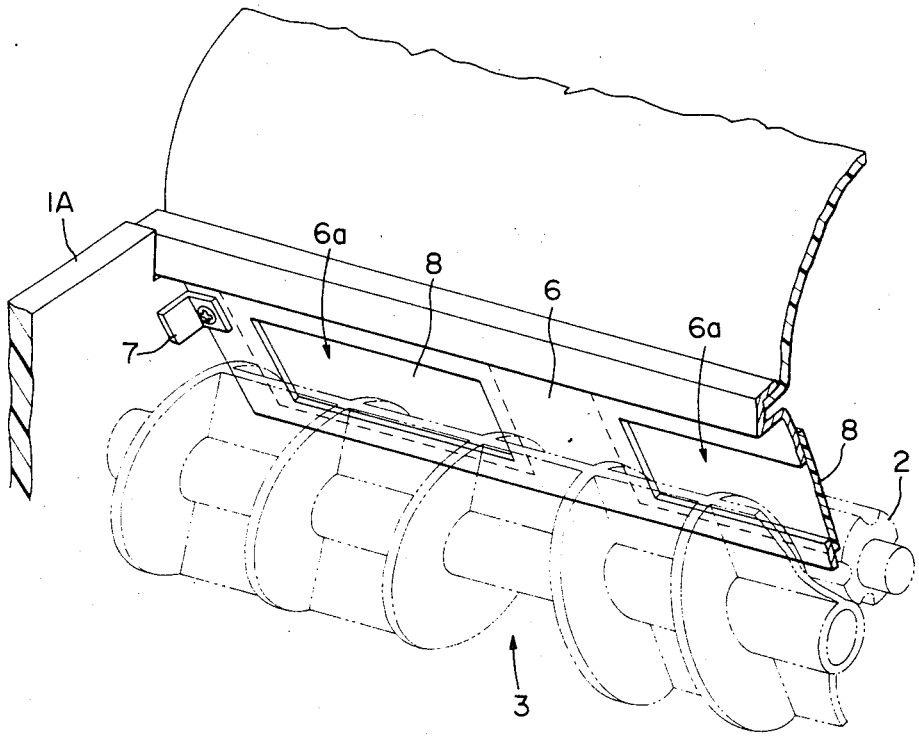
FIG. 2 is an enlarged perspective view showing an essential portion of the same developing device and taken in the direction of a developer bath.

In the present invention, the aforementioned agitating blades 3 are arranged in the vicinity of and to face the apertures **6*a* of the partition 6 and are rotationally driven clockwise in FIG. 1. Since the agitating blades 3 are a plurality of blades inversed at the axial center thereof, as shown in FIG. 2, the developer in the developer bath is also agitated not only in the rotating direction but also in the axial direction of the agitating blades 3 when the blades 3** are rotated.

Since the shown embodiment has the construction thus far described, the image retainer D, the agitating blades 3 and the developing sleeve 4 are rotationally driven during the run of the reproducing machine in their individual directions indicated by respective arrows. As a result, the developer frictionally charged by the agitating blades 3 is magnetically attracted by the circumference of the developing sleeve 4, and the developer having its thickness regulated by the doctor blade 5 is supplied to the image retainer D so that an electrostatic latent image on the circumference of the image retainer D is developed.

In the case of the agitating actions of those agitating blades 3, a portion of the developer to be mixed is splashed up toward the partition 6 to impinge upon the surfaces of the elastic plates 8 of the partition 6. The elastic plates 8 are deformed by the impinging pressure, but this impinging energy is irregular, and the developer is periodically agitated in the axial direction of the blades 3, too, so that the deformation of the elastic plates 8 is varied with time. As a result, the developer in the supply hopper 1*b* is not stabilized as a result of the deformation of the elastic plates 8 holding developer particles so that the bridging phenomena of the developer in the supply bath can be prevented in advance. Of course, no noise is generated because the impinging of the developer against the elastic plates 8 is almost noiseless.

As is now apparent from the description thus far made, according to the present invention, the easily deformable elastic plates are attached to the apertures of the partition dividing the developer bath and the inside of the supply hopper. With this simple construction, the bridging phenomena of the developer in the supply hopper can be prevented in advance, and the elastic plates are deformed by the developer being agitated by the agitating blades so that a noiseless run can be expected.

Further, the precise developing conditions such as the arrangement of the developing sleeve and the image retainer are not subjected under such bad influence that a large vibration is applied on the partition itself or a shock is applied on the developing sleeve.

What is claimed is:

1. A developing device for a reproducing machine or the like, in which a developer supply hopper is incorporated into a developer bath arranged to face an image retainer, characterized in that apertures are formed in a partition provided between the developer bath, which has a developing sleeve and developer agitating blades therein, and said developer supply hopper; in that said apertures are covered with easily deformable thin elastic plates; and in that said developer agitating blades in said developer bath are arranged in the vicinity of said apertures.

2. A developing device for a reproducing machine or the like comprising a developer bath having there in a rotatable developing sleeve and a developer agitating member, a developer supply hopper for receiving developer for replenishment, a partition provided between the developer bath and the developer supply hopper having at least one aperture covered with a vibratable elastic plate, and a feed roller for supplying the developer for replenishment in said developer supply hopper to said developer bath, positioned below said developer supply hopper, wherein said developer agitating member is arranged in the vicinity of said partition with a clearance and said elastic plate is vibrated when the developer projected by the rotation of said developer agitating member is impinged to said aperture.

3. The developing device according to claim 2, wherein said elastic plate is a thin resin plate.

4. The developing device according to claim 2, wherein said elastic plate is a thin rubber film.

5. The developing device according to claim 2, wherein said developer agitating member has a plurality of blades.

6. The developing device according to claim 2, wherein said elastic plate is transparent.

7. The developing device according to claim 3, wherein said resin plate is a polyethylene terephthalate sheet.

8. The developing device according to claim 5, wherein said plural blades are arranged symmetrically in figure with respect to a plane near the axial center of a rotary shaft of said developer agitating member.

* * * * *